US010888982B2

(12) United States Patent
Cordeiro et al.

(10) Patent No.: US 10,888,982 B2
(45) Date of Patent: Jan. 12, 2021

(54) COMBUSTION CHAMBER FOR A GAS-POWERED FIXING TOOL

(71) Applicant: Illinois Tool Works Inc., Glenview, IL (US)

(72) Inventors: Pierre Cordeiro, Livron sur Drome (FR); Patrick Herelier, Saint Jean de Muzols (FR); Frederic Nayrac, Bourg les Valence (FR); Alain Vettoretti, Bourg les Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 543 days.

(21) Appl. No.: 15/379,022

(22) Filed: Dec. 14, 2016

(65) Prior Publication Data

US 2017/0173773 A1 Jun. 22, 2017

(30) Foreign Application Priority Data

Dec. 18, 2015 (FR) ..... 15 62719

(51) Int. Cl.
*B25C 1/08* (2006.01)

(52) U.S. Cl.
CPC ..... *B25C 1/08* (2013.01)

(58) Field of Classification Search
CPC .. B25C 1/08; B25C 1/085; B25C 1/10; B25C 1/12; B25C 1/14; B25D 9/10
USPC ..... 227/10
See application file for complete search history.

(56) References Cited

U.S. PATENT DOCUMENTS 2,730,082 A * 1/1956 Wampach ..... B25D 9/10 123/46 SC
3,042,008 A * 7/1962 Liesse ..... B21J 7/26 123/46 SC
3,850,359 A * 11/1974 Obergfell ..... B25C 1/08 173/209
3,949,921 A * 4/1976 Brack ..... B25C 1/085 227/9
4,200,213 A * 4/1980 Liesse ..... B25C 1/08 123/46 SC (Continued)

FOREIGN PATENT DOCUMENTS

WO WO 2005/099968 10/2005
WO WO-2005099968 A1 * 10/2005 ..... B25C 1/08

OTHER PUBLICATIONS

Canadian Office Action for Canadian Application No. 2,950,111, dated Oct. 3, 2017 (4 pages).

*Primary Examiner* — Anna K Kinsaul
*Assistant Examiner* — Veronica Martin
(74) *Attorney, Agent, or Firm* — Neal, Gerber & Eisenberg LLP

(57) ABSTRACT

Various embodiments of the present disclosure provide a gas-powered fastener-driving tool. In one embodiment, the tool includes a combustion or precombustion chamber a valve comprising a body that is mobile within the combustion or precombustion chamber between a first closed position and a second open position. The body defines two opposing orifices at longitudinal ends of the body. The orifices form part of a bore defined through the body that enables gas to pass through the valve. This makes it possible to limit the pressure drops as gas is being admitted to or exhausted from the chamber, thus making it possible to optimize the duration of the firing cycle of the tool.

16 Claims, 4 Drawing Sheets

(56) References Cited

U.S. PATENT DOCUMENTS

| | | | | |
|---|---|---|---|---|
| 4,721,240 | A * | 1/1988 | Cotta | B25C 1/08 123/46 SC |
| 8,925,517 | B2 * | 1/2015 | Adams | B23Q 5/033 123/258 |
| 2007/0131731 | A1 * | 6/2007 | Moeller | B25C 1/08 227/10 |
| 2007/0138230 | A1 * | 6/2007 | Gschwend | B25C 1/08 227/10 |
| 2010/0187280 | A1 * | 7/2010 | Akiba | B25C 1/08 227/10 |
| 2012/0210974 | A1 * | 8/2012 | Adams | B23Q 5/033 123/253 |
| 2017/0173773 | A1 * | 6/2017 | Cordeiro | B25C 1/08 |

* cited by examiner

COMBUSTION CHAMBER FOR A GAS-POWERED FIXING TOOL

PRIORITY CLAIM

This patent application claims priority to and the benefit of French Patent Application No. 1562719, which was filed on Dec. 18, 2015, the entire contents of which are incorporated herein by reference.

TECHNICAL FIELD

The present disclosure relates to a combustion or precombustion chamber for a gas-powered fixing tool such as a nail gun for example.

BACKGROUND

The present disclosure relates to anchoring or fixing tools, the to be gas-powered, which means tools comprising an internal combustion engine that works by igniting an air-fuel mixture inside a combustion chamber, the fuel being injected into the chamber by an injection device from a fuel receptacle referred to as a gas cartridge. These tools are intended to drive fixing elements into supporting materials so that components can be fixed thereto. Gas-powered nail guns are very commonplace these days. As examples of fuels for the internal combustion engine, mention may be made of gasoline, alcohol, in liquid and/or gas form.

In general, this type of tool is portable and comprises a casing in which the internal combustion engine that propels a piston that drives a fixing element is mounted. This type of tool may also comprise an electric battery as well as a holding, handling and firing handgrip on which a trigger by means of which the tool is actuated is mounted.

A firing cycle comprises several steps such as the distribution of a quantity of fuel via the cartridge, the admission of the fuel into the chamber, the mixing of the fuel with air in the chamber, the ignition and combustion of the mixture in order to drive the piston, and the evacuation of the combustion gases from the chamber.

A combustion chamber comprises at least one gas intake or exhaust valve. This valve comprises a body that is mobile between a closed first position in which a gas intake or exhaust orifice is closed and an open second position in which this orifice is open.

The valves used in the state of the art have disadvantages. Specifically, their configurations give rise to significant pressure drops when the gas is being admitted or exhausted, and these lengthen the duration of the firing cycle. A valve is known for example in which the mobile body has an elongate form along an axis and comprises orifices for the passage of gas which are oriented radially with respect to this axis. The gas has to pass radially through these radial orifices then circulate longitudinally along the axis. This winding path leads to the aforementioned pressure drops and has a tendency to slow down the firing cycle of the tool.

The present disclosure proposes a solution to the problem which is simple, effective and economical.

SUMMARY

The present disclosure thus proposes a combustion or precombustion chamber for a gas-powered fixing tool, comprising at least one valve, such as a gas intake or exhaust valve, the valve comprising a body that is mobile between a first closed position and a second open position, characterized in that the body has a tubular elongate form and comprises an internal bore emerging at the two longitudinal ends of the body to form, respectively, two orifices for the longitudinal passage of gas.

In the present application, a precombustion chamber is intended to mean a chamber in which precombustion of an air-fuel mixture is intended to take place, before this mixture is injected into a combustion chamber to complete the combustion of the mixture.

According to the present disclosure, the mobile body of the valve is "hollow" which means that its internal bore is open at the two longitudinal ends of the body. The body thus comprises two axial or longitudinal orifices that enable the gas to circulate more or less in a straight line, and therefore without twists and turns. This makes it possible to limit the pressure drops as gas is being admitted to or exhausted from the chamber, thus making it possible to optimize the duration of the firing cycle of the tool.

The chamber according to the present disclosure may comprise one or more of the following features, considered in isolation from one another or in combination with one another:

- the body has a generally cylindrical shape;
- the body bears, at its outer periphery, at least one seal;
- the at least one seal extends in a transverse plane passing substantially through one of the abovementioned two orifices;
- the body is mounted to be mobile in longitudinal translation in a casing, in certain embodiments formed by an assembly of parts or of elements;
- the casing comprises a first tubular cylindrical element of elongate form in which the body is housed and can slide;
- the casing comprises a second cylindrical element configured to be engaged in the body when the latter is in the closed position;
- the second element bears, at its outer periphery, at least one seal configured to cooperate with the body, the at least one seal in certain embodiments extending in a transverse plane passing substantially through one of the abovementioned two orifices;
- the second element comprises an outer annular flange and is surrounded by a return spring bearing respectively on the flange and on the body, in order to bias the latter into its open position;
- the casing comprises a third element comprising an internal bore in which the body is intended to slide, the third element comprising at least one orifice for the passage of gas emerging in this bore and oriented substantially radially relative to the longitudinal axis of the body, this orifice being configured to be blocked by the body when it is in its closed position and left free when it is in its open position;
- the body is linked by a member of elongate form to a valve shutter or disc and/or to another mobile body of a valve;
- the body is linked to a rectilinear rod extending along the longitudinal axis of the body and having an outer diameter less than the inner diameter of the bore of the body;
- the rod is linked by legs to one of the longitudinal ends of the body;
- the body is linked either to a sheath having an inner diameter substantially identical to the inner diameter of the bore of the body, or to one or more rectilinear rods extending over a circumference of a diameter substantially identical to that of the body;

the orifices for the passage of gas have circular passage cross sections;

the orifices for the passage of gas have substantially identical passage cross sections;

the orifices for the passage of gas have passage cross sections that are defined by internal diameters of the two longitudinal ends of the body.

The present disclosure also relates to a gas-powered fixing tool, characterized in that it comprises at least one combustion chamber as described hereinabove.

BRIEF DESCRIPTION OF THE DRAWINGS

The present disclosure will be better understood and further details, features and advantages of the present disclosure will become more clearly apparent from reading the description which follows, given by way of nonlimiting example, and by referring to the attached drawings.

DETAILED DESCRIPTION

Figure 1:
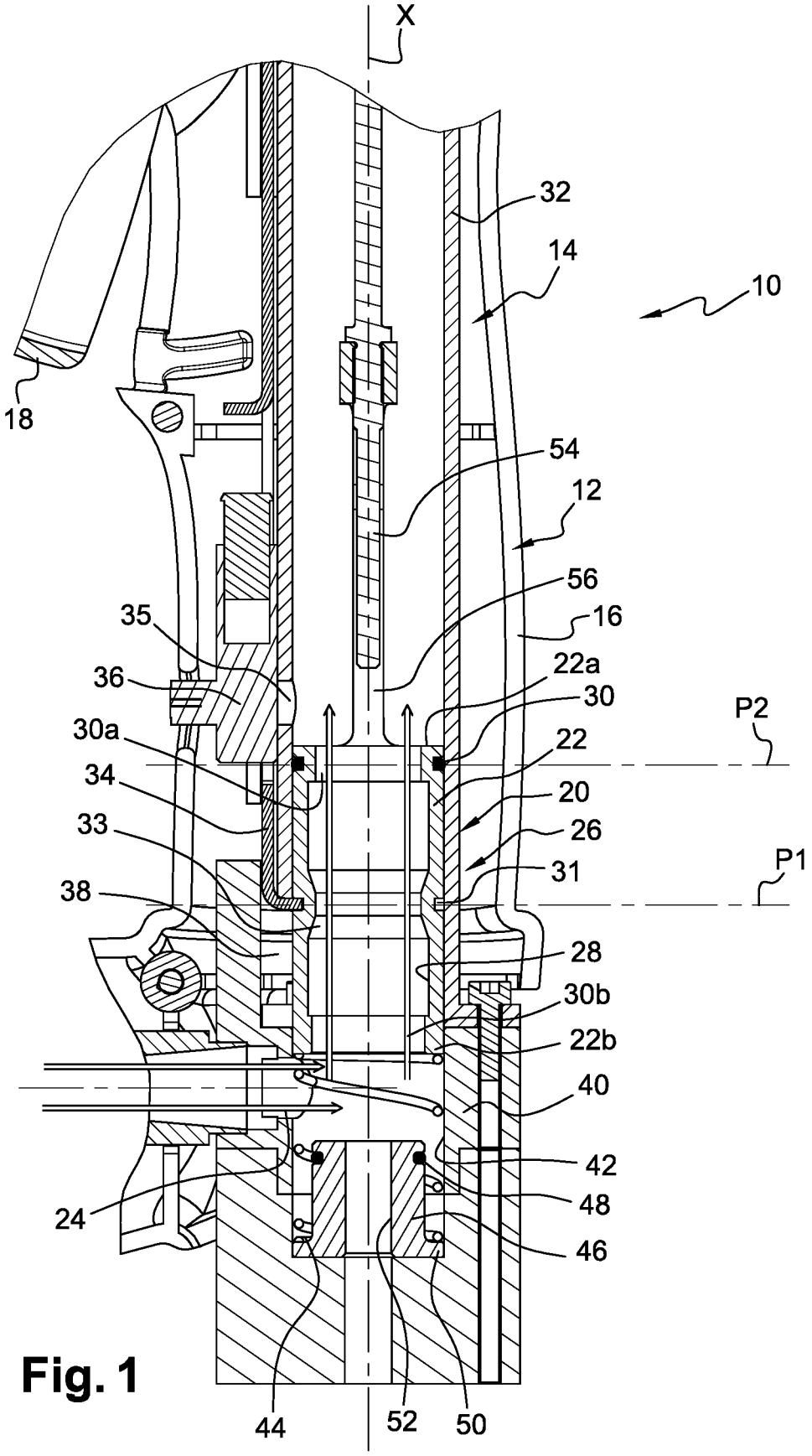
FIG. 1 is a schematic partial view in axial section of a combustion chamber of a gas-powered fixing tool of the present disclosure, this chamber comprising a valve including a mobile body in an open position.

The fixing tool 10 (sometimes called the "tool" for brevity) is partially visible in the drawings. This tool comprises a casing 12 in which there is an internal combustion engine with a combustion chamber 14 (or a precombustion chamber and a combustion chamber) that is intended to contain a mixture of air and fuel the ignition of which propels a piston intended to drive a fixing element taken from a feed magazine, the fixing element being intended to be anchored in a support material, at the outlet of a nail guide extending at the front of the casing. All of these components of gas-powered fixing tools are perfectly well known to those skilled in the art and have therefore not all been depicted in the drawings.

The supply of fuel to the combustion chamber 14 of the motor is effected via an injection member from a fuel gas cartridge.

The casing 12 of the tool comprises a handgrip 16 for holding and handling the tool. The handgrip 16 is also used for firing, by means of an actuating trigger 18 mounted thereon.

In the example depicted, the combustion chamber 14 comprises an intake valve 20 for the fuel gas delivered by the cartridge. This valve 20 is hollow or, more precisely, its mobile body 22 is hollow.

Figure 2:
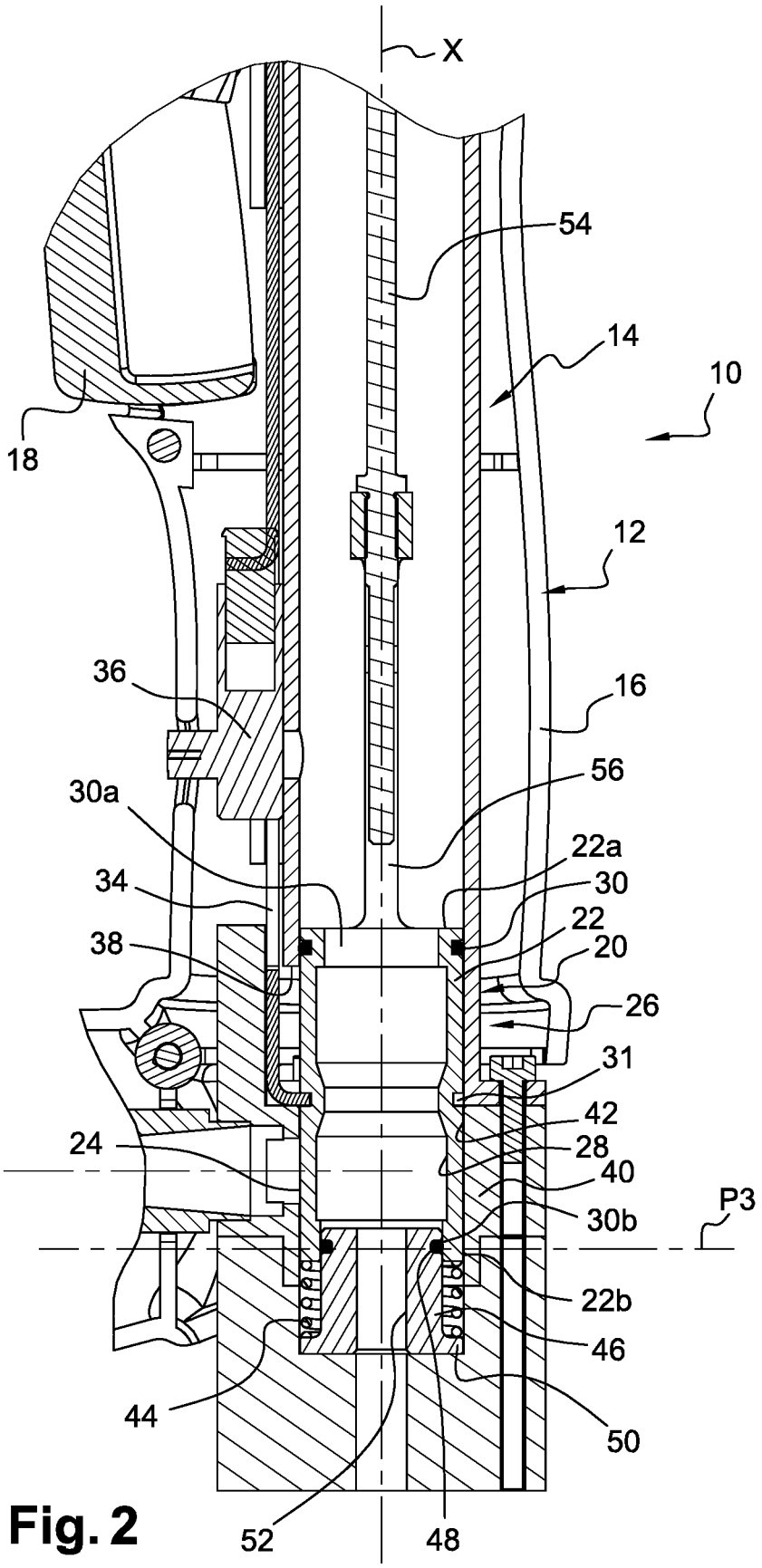
FIG. 2 is a view corresponding to FIG. 1 and in which the mobile body is in a closed position.

The mobile body 22 is mobile between a position in which an intake orifice 24 is open, which position is depicted in FIG. 1, and a position in which the intake orifice 24 is closed, which position is depicted in FIG. 2.

The mobile body 22 is able to move in a fixed casing 26 of the combustion chamber, which in this instance is formed by an assembly of parts or elements which will be described in detail in what follows.

The body 22 has a tubular elongate form and comprises an internal bore 28 emerging at the two longitudinal ends 22*a*, 22*b* of the body to form, respectively, two orifices 30*a*, 30*b* for the longitudinal passage of gas.

The body 22 has a generally cylindrical form in the example depicted. It comprises an outer cylindrical surface and has an outside diameter that is substantially constant. At its end 22*a* it comprises an outer annular groove in which there is mounted a seal 30 intended to collaborate with the casing 26. It also comprises, substantially in its middle, an outer annular groove 31 in which one end of a finger 34 actuated by the trigger 18 is intended to engage.

The end 22*a* of the body comprises an inner annular flange defining the orifice 30*a*, which is a gas exhaust orifice. The end 22*b* of the body comprises an inner annular flange defining the orifice 30*b*, which is a gas intake orifice. These flanges have substantially the same inside diameter.

Although this is not in any way limiting, the bore 28 of the body has a restriction 33 of its passage cross section substantially in the middle of the body. This restriction 33 defines an inside diameter substantially equal to that of the aforementioned flanges.

The restriction 33 and the groove 31 are situated substantially in the same plane P1 transverse to the longitudinal axis X of the mobile body 22. The seal 30 is situated in another transverse plane P2 passing substantially through the orifice 30*a* of the body 22.

The casing 26 of the chamber comprises a tubular cylindrical element 32 in which the body 22 is housed and can slide. This element 32 has an elongate form with longitudinal axis X.

The element 32 comprises an internal cylindrical surface collaborating with the seal 30 borne by the body 22.

In the example depicted, the element 32 comprises an orifice 35 that is radial (with respect to the axis X) and through which one end of an igniter plug 36 can pass to initiate combustion of the air-fuel mixture in the chamber. This plug 36 may be of the piezoelectric type and be actuated by the aforementioned finger 34 when the user operates the trigger 18.

The element 32 further comprises a radial through-slot 38 which has a form that is elongate along the axis X. The finger 34 comprises an end which passes through the slot 38 and is engaged in the groove 31 of the body. When the trigger 18 is actuated, the finger 34 is moved translationally along the axis X, and its end slides in the slot to drive the mobile body 22 into the casing 26 of the chamber. It will thus be appreciated that the length of the slot (the dimension along the axis X) is dependent on the expected travel of the body 22. Advantageously, and as may be seen in the drawings, whatever the position of the body 22 along the axis, the slot 38 is covered and therefore closed off by the body 22.

The casing 26 comprises another element 40 mounted at one longitudinal end of the element 32. This other element 40 comprises an internal bore 42 communicating with the internal housing of the element 32.

The bore 42 has a generally cylindrical form with axis X of revolution and is therefore coaxial with the internal housing of the element 32. This bore 42 in certain embodiments has an inside diameter substantially equal to the inside diameter of this internal housing.

The body 22 of the valve is able to slide in the bore 42.

The element 40 comprises a radial orifice emerging into the bore 42 and forming the aforementioned intake orifice 24. This orifice 24 communicates with the aforementioned injection member to supply the combustion chamber with fuel.

As may be seen in the drawings, when the body 22 is in its open position (FIG. 1), the orifice 24 is left uncovered, enabling fuel to enter the bore 42 then pass longitudinally along the body 22 (cf. arrows). When the body 22 is in its closed position (FIG. 2), the orifice 24 is hermetically closed off by the body 22.

It will thus be appreciated that the travel of the body, between its two extreme positions, is greater than the diameter of the orifice 24, so that the body does not impede the passage of gas through the orifice 24 in the open position (in this instance the high position), and so that the body completely closes off the orifice in the closed position (in this instance the low position).

The casing 26 further comprises another element 46 of generally cylindrical form aligned with the axis X. This element 46 is arranged at one end of the chamber and is intended to be partially housed in the bore of the body 22 when the latter is in the closed position (FIG. 2).

This element 46 at its outer periphery comprises an outer annular groove to house a seal 48 intended to collaborate with the flange of the end 30*b* of the body 22. The seal 48 is situated in another transverse plane P3.

The element 46 at its opposite longitudinal end to the body 22 comprises an outer annular flange 50 the outside diameter of which is here substantially identical to that of the body 22. A return spring 44, in this instance a helical spring, is mounted around the element 46 and comprises a first end bearing against the flange 50 and an opposite end bearing against the end 30*b* of the body in order to bias it into its open position.

As can be seen in the drawings, the element 46 may comprise an internal axial bore 52 for the passage of an igniter plug (not depicted) in the place of the aforementioned one. The bore 52 here is aligned with the axis X.

The end 30*a* of the body is connected to a cylindrical rod 54 of longitudinal axis X. This rod 54 has a diameter smaller than the inside diameter of the body. Its diameter is in certain embodiments comprised between 0.1 and 0.3 times the inside diameter of the body, and is, for example, from 0.15-0.16 times the inside diameter of the body.

The rod 54 has a length that is markedly greater than that of the body 22 and extends into the element 32 of the casing 26. Its longitudinal end situated on the body side is connected to the end 30*a* of the body by two, three, or more legs 56. These legs 56 are uniformly distributed about the axis X and are therefore diametrically opposed when there are two of them. The legs 56 are intended to have the gas passing between them and are in certain embodiments profiled in order to limit operational pressure drops (arrows).

Figure 3:
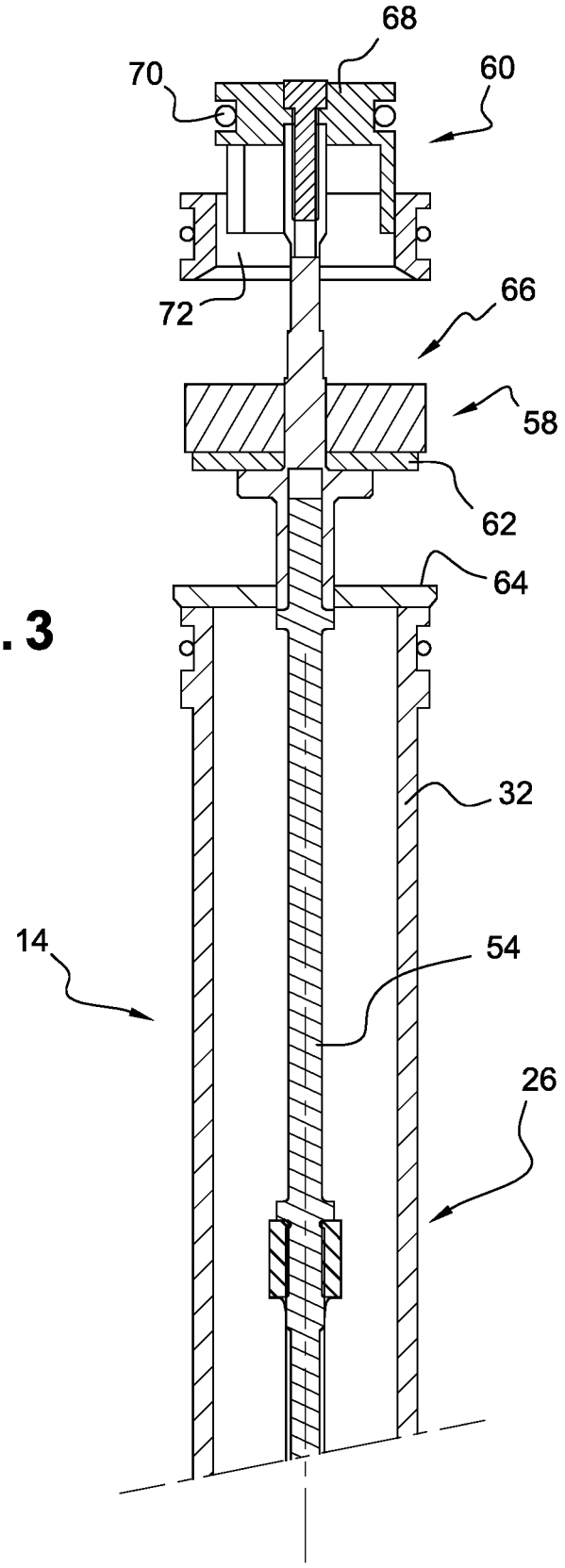
FIG. 3 is another partial schematic view in axial section of the combustion chamber of FIG. 1.

As can be seen in FIG. 3, the opposite end of the rod 54 to the body may be connected to a valve shutter 58 and/or to another valve 60, such as an exhaust valve.

The valve shutter 58 for example comprises a disc 62 through which the rod 54 passes and which is secured thereto. The disc 62 is intended to collaborate with an annular seat 64 of the element 32 of the casing. FIG. 3 illustrates the valve shutter 58 in the open position, the disc 62 being away from its seat. This scenario corresponds to the open or upper position of the body 22 (FIG. 1). In the closed or lower position of the body 22, the disc 62 collaborates in a sealed manner with the seat 64. The seat 64 may define an orifice for the passage of gas from the combustion chamber 14, which is a precombustion chamber, to another combustion chamber 66.

In the example depicted, the valve 60 comprises a mobile body 68 in the form of a disc or piston which at its external periphery bears a seal 70 intended to collaborate with an internal cylindrical surface of an orifice 72 for exhausting combustion gases from the combustion chamber 66.

It is important to note that this valve 60 could be equipped with a mobile body similar to that 22 of the other valve.

The fixing tool 10 and the combustion chamber 14, 66 may operate as follows. In general, the placing of one end of the tool on the support material into which a fixing element is to be affixed enables a quantity of fuel to be released from the cartridge, this fuel being conveyed from the cartridge to the intake orifice 24 of the element 40. The fuel enters the precombustion chamber 14 because of the opening of the valve (mobile body 22 in the upper or open position as shown in FIG. 2). The user generally has a few seconds to spare before the fuel is diffused into the atmosphere and in which to actuate the trigger 18. When the trigger 18 is actuated, the finger 34 is moved, causing both the body 22 to move from its open position into its closed position, and the generation of a spark by the igniter plug 36. This spark brings about precombustion of the air-fuel mixture in the combustion chamber 14, which causes an increase in pressure in the chamber 14, which means inside the element 32. When this pressure overtakes a certain threshold, the valve shutter 58 opens and enables the mixture to pass into the combustion chamber, the pressure in which increases. Shortly afterwards, the flame passes in turn through the valve shutter 58 and ignites the combustion chamber 66 and causes the piston to move and a fixing element to be ejected into the support material. After the piston has returned to its rest position, the valve 60 opens to expel the combustion gases through the exhaust orifice 72.

Figure 4:
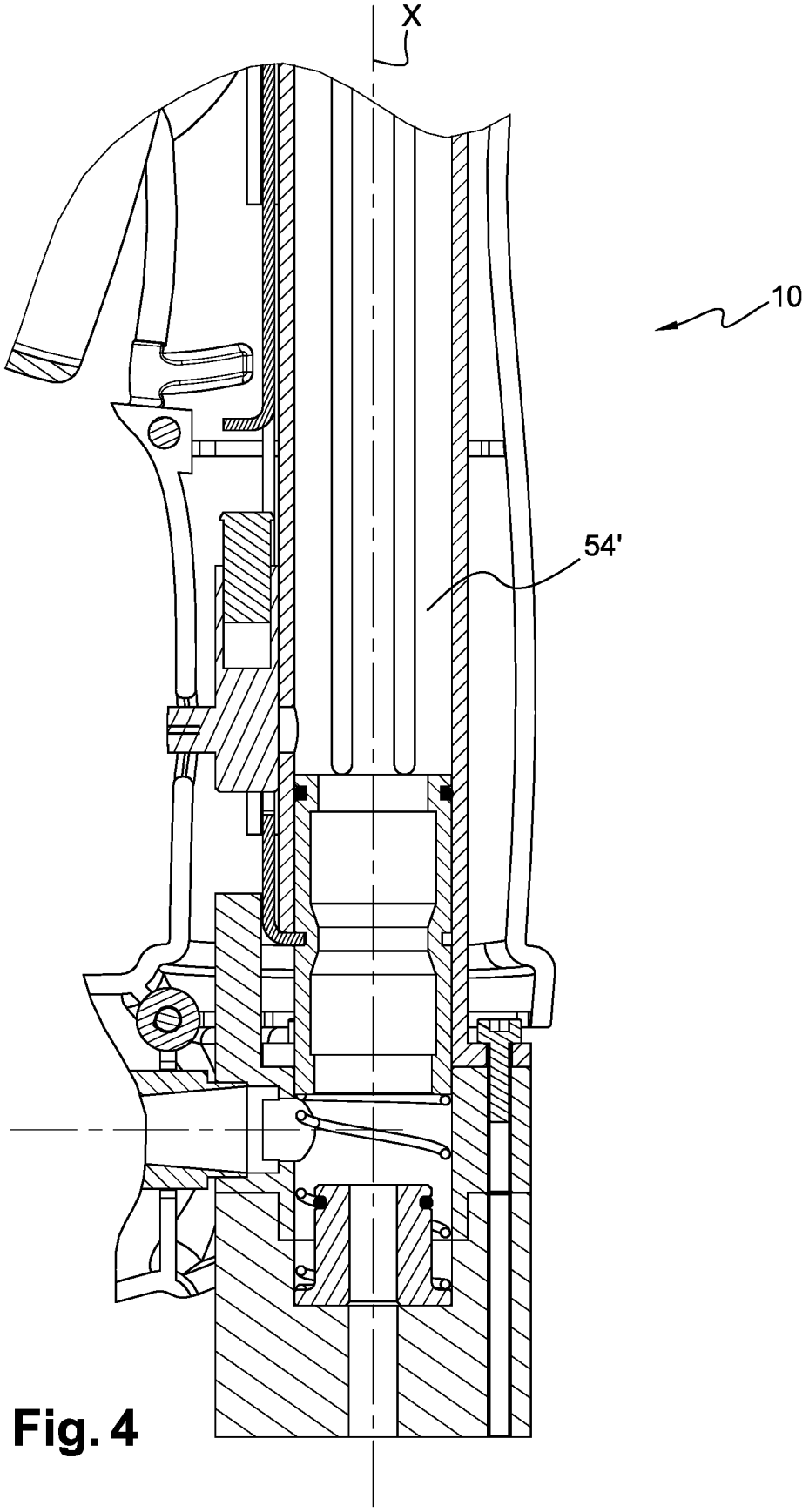
FIG. 4 is a view corresponding to FIG. 1 and illustrates an alternative embodiment of the present disclosure.

FIG. 4 illustrates an alternative form of embodiment of the present disclosure in which the rod 54 is replaced by a sleeve 54' having an inside diameter substantially identical to the inside diameter of the bore 28 of the body 22, or rectilinear rods extending over a circumference of diameter substantially identical to that of the body.

The invention claimed is:

1. A gas-powered fastener-driving tool comprising:

a combustion or precombustion chamber;

a valve comprising a body that is mobile within the combustion or precombustion chamber between a first closed position and a second open position, wherein the body defines two opposing orifices at longitudinal ends of the body, wherein the orifices form part of a bore defined through the body that enables gas to pass longitudinally through both orifices of the body of the valve into the combustion or precombustion chamber;

a spring configured to bias the body to the second open position; and a trigger mounted to a handgrip, wherein the trigger is actuatable to cause the body to move from the second open position to the first closed position.

2. The tool of claim 1, wherein the body is cylindrical.

3. The tool of claim 1, which includes a seal attached to the body and extending around an outer periphery of the body.

4. The tool of claim 3, wherein the seal extends in a plane that passes through one of the orifices.

5. The tool of claim 1, which includes a casing having a longitudinal axis, and wherein the body is mounted within the casing so the body is mobile relative to the casing and along the longitudinal axis of the casing.

6. The tool of claim 5, wherein the casing comprises a first elongate, cylindrical, and tubular element in which the body is housed.

7. The tool of claim 6, wherein the casing comprises a second cylindrical element positioned and sized so part of the second cylindrical element is received in one of the orifices of the body of the valve when the body is in the closed position.

8. The tool of claim 7, which includes a seal attached to the second element and extending around an outer periphery of the second element, wherein the seal extends in a plane that passes through one of the orifices, and wherein the seal sealingly engages the body when the body is in the closed position.

9. The tool of claim 8, wherein the second element comprises an outer annular flange, and wherein the spring bears on the outer annular flange and on the body to bias the body to the open position.

10. The tool of claim 7, wherein the casing comprises a third element that defines an internal bore in which the body is at least partially disposed when in the closed position, the third element defining an orifice enabling passage of gas therethrough, the orifice oriented substantially radially relative to a longitudinal axis of the body, wherein the body blocks the orifice when the body is in the closed position and does not block the orifice when the body is in the open position.

11. The tool of claim 1, which includes a member and a valve shutter or disc, wherein the member links the body to the valve shutter or disc.

12. The tool of claim 11, wherein the member includes a rectilinear rod that extends along a longitudinal axis of the body and has an outer diameter that is less than an inner diameter of the bore of the body.

13. The tool of claim 12, which includes multiple legs that link the rod to one of the longitudinal ends of the body.

14. The tool of claim 1, which includes a sheath having an inner diameter substantially identical to an inner diameter of the bore of the body, the sheath linked to the body.

15. A gas-powered fastener-driving tool comprising:

a combustion or precombustion chamber;

a valve comprising a body that is mobile within the combustion or precombustion chamber between a first closed position and a second open position, wherein the body defines two opposing orifices at longitudinal ends of the body, wherein the orifices form part of a bore defined through the body that enables a gas to pass longitudinally through both orifices of the body of the valve into the combustion or precombustion chamber; and a spring configured to bias the body to the second open position, wherein a first end of the spring contacts the body adjacent to a first orifice of the two opposing orifices, and wherein the spring is positioned to enable the gas to pass through the spring directly into the first orifice of the body of the valve when the body is in the second open position.

16. A gas-powered fastener-driving tool comprising:

a combustion or precombustion chamber;

a valve comprising a body that is mobile within the combustion or precombustion chamber between a first closed position and a second open position, wherein the body defines two opposing orifices at longitudinal ends of the body, wherein the orifices form part of a bore defined through the body that enables a gas to pass longitudinally through both orifices of the body of the valve into the combustion or precombustion chamber;

a spring configured to bias the body to the second open position; and a casing that defines an internal bore in which the body is at least partially disposed when in the first closed position, the casing fully defining an orifice positioned radially outward from the body, wherein the body blocks the orifice when the body is in the first closed position and does not block the orifice when the body is in the second open position, and wherein a size of the orifice is the same when the body is in the first closed position and the second open position.

* * * * *